US009487958B2

(12) United States Patent
Roy

(10) Patent No.: US 9,487,958 B2
(45) Date of Patent: Nov. 8, 2016

(54) COMPOSITE ENGINEERED WOOD MATERIAL PIECE COMPOSED OF AN HDF MID-LAYER AND AN OSB BOTTOM LAYER

(71) Applicant: BOA-FRANC S.E.N.C., Saint-Georges (CA)

(72) Inventor: François Roy, Saint-Georges (CA)

(73) Assignee: BOA-FRANC S.E.N.C., Saint-Georges, QC ( * ) Notice: Subject to any disclaimer, the term of this patent is extended or adjusted under 35 U.S.C. 154(b) by 158 days.

(21) Appl. No.: 14/121,406

(22) Filed: Sep. 2, 2014

(65) Prior Publication Data

US 2016/0060881 A1 Mar. 3, 2016

(51) Int. Cl.
*E04F 15/04* (2006.01)
*E04F 15/02* (2006.01)

(52) U.S. Cl.
CPC ..... *E04F 15/042* (2013.01); *E04F 15/02038* (2013.01); *E04F 2201/0107* (2013.01)

(58) Field of Classification Search
CPC ..... E04F 15/042
USPC ..... 428/114, 60, 80, 57, 55
See application file for complete search history.

(56) References Cited

U.S. PATENT DOCUMENTS

| | | | | |
|---|---|---|---|---|
| 6,565,959 | B1 | 5/2003 | Tingley | |
| 7,431,979 | B2 | 10/2008 | Grafenauer | |
| 7,473,457 | B2 | 1/2009 | Han et al. | |
| 7,665,263 | B2 | 2/2010 | Yau | |
| 7,926,239 | B2 | 4/2011 | Hahn et al. | |
| 8,202,389 | B2 | 6/2012 | Handojo | |
| 8,591,696 | B2 | 11/2013 | Smith | |
| 2005/0221904 | A1 | 10/2005 | Ford et al. | |
| 2005/0235593 | A1 | 10/2005 | Hecht | |
| 2005/0268571 | A1 | 12/2005 | Magnusson | |
| 2006/0099386 | A1 | 5/2006 | Smith | |
| 2006/0234027 | A1 | 10/2006 | Huusken | |
| 2007/0102108 | A1* | 5/2007 | Zheng | B27D 1/04 156/272.2 |
| 2008/0203604 | A1 | 8/2008 | Lalancette | |
| 2009/0155612 | A1 | 6/2009 | Pervan et al. | |
| 2009/0234874 | A1 | 9/2009 | Sylvain | |
| 2010/0311854 | A1 | 12/2010 | Thiers et al. | |
| 2011/0293904 | A1 | 12/2011 | Smith | |

FOREIGN PATENT DOCUMENTS

| | | |
|---|---|---|
| WO | WO 2004/009931 | 1/2004 |
| WO | WO 2011/144485 | 11/2011 |

* cited by examiner

*Primary Examiner* — Brent O'Hern
(74) *Attorney, Agent, or Firm* — Houle Patent Agency Inc.

(57) ABSTRACT

A composite engineered wood material piece, such as a floor board or wood material sheet, is comprised of a thin top quality wood material layer bonded onto a high density fiber board (HDF) material which is itself bonded onto a thick bottom substrate oriented strand board (OSB) material layer. The OSB material layer has its particle orientation in the top surface disposed parallel to the grain orientation in the top quality wood material layer. The HDF layer resists to the stress exhibited in the top layer and acts has a transition layer to secure the top layer to the bottom layer. It also strengthens the composite floor board or wood material sheet.

19 Claims, 1 Drawing Sheet

COMPOSITE ENGINEERED WOOD MATERIAL PIECE COMPOSED OF AN HDF MID-LAYER AND AN OSB BOTTOM LAYER

TECHNICAL FIELD

The present invention relates to engineered wood material pieces and more particularly to floor boards and wood material sheets having a thin quality wood material top layer bonded to a mid-layer HDF material which is bonded to an oriented strand board OSB bottom layer.

BACKGROUND ART

Engineered floor boards composed of laminated wood material layers are known whereby to provide an aesthetically pleasing appearance floor board at reduce cost due to the high cost of quality hardwood, such as maple wood, oak and walnut, to mention a few. When laminating or bonding different types of wood products together to create engineered floor boards various problems come into play has these different products react differently to changing climatic conditions particularly when subjected to humidity and loads subjecting the board to flexion and torsion. Another problem with these engineered floor boards is the telegraphy reflected in the top surface of the top layer which is a thin layer of quality wood and that problem has been addressed in our Canadian Patent No. 2,643,180 and entitled "Composite Engineered Wood Material Piece", ranted on May 5, 2008. Reference is also made to US Patent Publication 2005/0268571, published on Dec. 8, 2005, which relates to a three layer hardwood floor board having a non-hardwood material middle layer which may be made from HDF or MDF boards.

Due to the rising cost of quality wood, the flooring manufactures strive to fabricate quality engineered wood floors at the lowest possible costs while considering the quality aspect of the product. Due to the high cost of the top wood layer of such floor board products, the thickness of the top wood layer is reduced and laminated to one or more substrate of lower quality and cost while trying to achieve a finished product having an ideal thickness, usually in the order of about ¾ inch (19 mm). The use of a low quality wood products such as oriented strand board (OSB) as a thick substrate wood result in an ideal solution to reduce costs. However, that product has certain disadvantages if bonded to a thin quality wood layer due to its composition of irregular compressed wood strands and flakes. Also, OSB tends to swell under local humid conditions and irregularities in its surface bonded to the thin top layer cause distortion and reflect or telegraph into the thin top layer causing an unpleasing appearance and distortion.

The use of an OSB layer as a substrate also has further problems to be resolved, such as the variable density thereof which poses the risk of the product delaminating when subjected to certain climatic conditions. The thicker is the top layer, the higher is the risk of fracturing the substrate and delaminating. Still further, because the OSB is formed or irregular wood strands and flakes lying unevenly across each other and mixed with adhesive and then pressed together, the outer surface of such wood boards is irregular and not perfect which would make it difficult to glue to the flat undersurface of the top layer and achieve a perfect bond between the thin top wood layer and the top surface of the OSB.

It would be desirable to use OSB as a substrate to fabricate a composite wood material piece to form floor boards or sheets including such product and overcome the above mentioned disadvantages of the OSB.

SUMMARY OF THE INVENTION

It is a feature of the present invention to provide a composite engineered wood material piece which substantially overcomes the above mentioned disadvantages of using OSB as a substrate in the fabrication of such floor board.

Another feature of the present invention is to provide a composite engineered floor board or wood material sheet comprised of a thin quality wood top layer bonded to an OSB bottom layer through a high density fiber (HDF) board mid-layer and wherein the mid-layer acts has a strengthening and transition layer between the quality wood top layer and the OSB bottom layer.

Another feature of the present invention is to provide a composite engineered floor board or wood material sheet using OSB as a sub-layer to reduce the cost of fabrication of the floor board while maintaining a high degree of quality.

Another feature of the present invention is to provide a composite engineered floor board or wood material sheet using OSB as a sub-layer to permit increasing the thickness of the floor board while maintaining a low cost of fabrication and a high degree of quality.

A still further feature of the present invention is to provide a composite engineered floor board or wood material sheet using OSB as a sub-layer while preventing the telegraphy of the irregularities in the top surface of the OSB into the top surface of the quality wood top layer.

According to the above mentioned features, from a broad aspect, the present invention provides a composite engineered wood material sheet having a top layer formed of a quality wood product bonded to a top surface of a middle layer. The middle layer is formed from a high density fiber board (HDF) material. A bottom layer formed of oriented strand board (OSB) material is bonded to a bottom surface of the high density fiber board. The oriented strand board has its particle orientation in the top surface thereof disposed parallel to the grain orientation of the top layer. The middle layer resists to stress exhibited by the top layer and provides improved bonding to the bottom layer, thus acting has a strengthening and transition layer between the top layer and the bottom layer. The bottom layer has a thickness which is greater than the thickness of the middle layer.

From a further broad aspect of the present invention, the wood material piece is an engineered floor board.

According to a still further broad aspect of the present invention there is provided a composite wood material sheet comprised of a top sheet layer formed of a quality wood product bonded to a top surface of a middle sheet layer formed from a high density fiber HDF board material. A bottom sheet layer formed of oriented strand board OSB material is bonded to a bottom surface of the high density fiber board. The middle layer resists to stress exhibited by the top layer and provides improved bonding to the bottom layer and thus acting has a strengthening and transition layer between the top layer and the bottom layer. The bottom layer has a thickness which is greater than the thickness of the middle layer.

BRIEF DESCRIPTION OF THE DRAWINGS

A preferred embodiment of the present invention will now be described with reference to the accompanying drawings in which.

DESCRIPTION OF PREFERRED EMBODIMENTS

Figure 2:
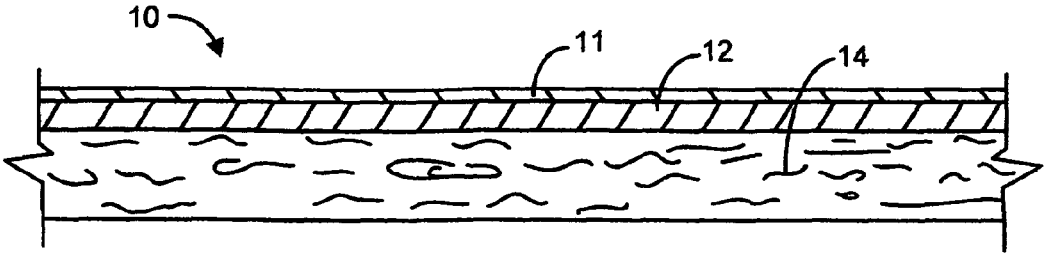
FIG. 2 is a cross-sectional view illustrating the three layer fabrication of the engineered floor board.
Figure 3:
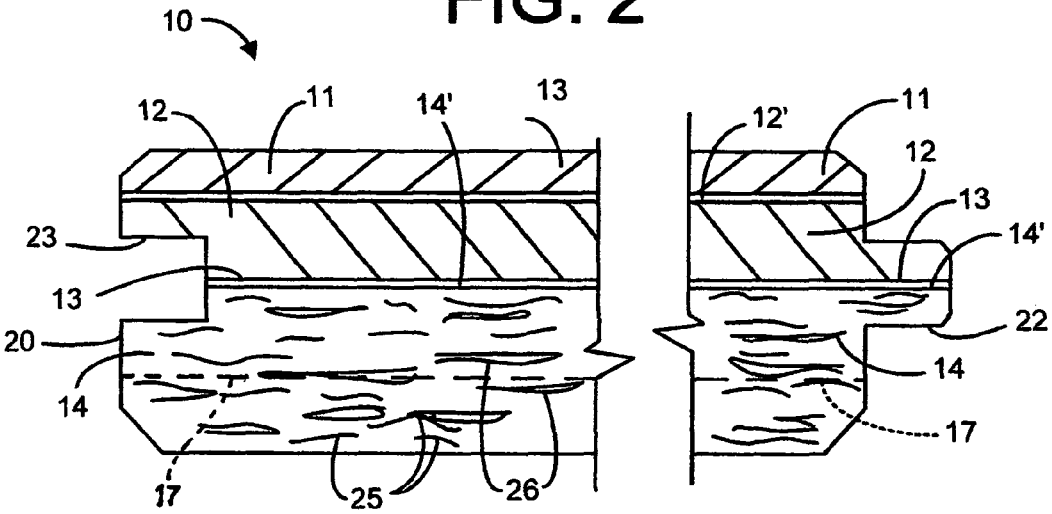
FIG. 3 is an enlarged, fragmented, cross-sectional view along cross-section line A-A of FIG. 1 of the composite engineered floor board showing tongue and groove formations formed in the side edges of the floor board.
Figure 1:
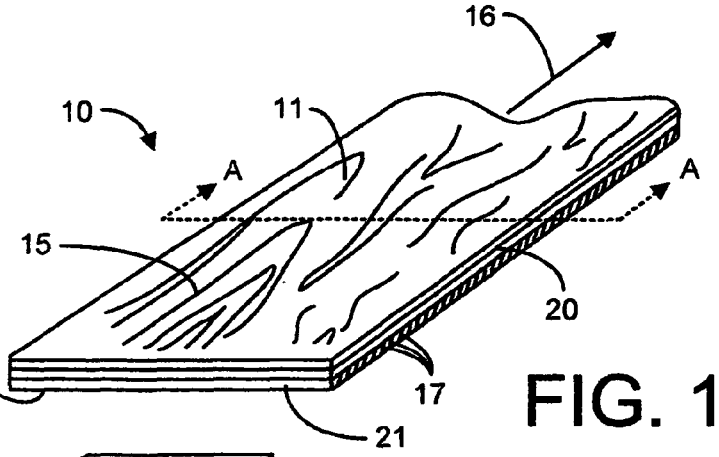
FIG. 1 is a fragmented section view of an engineered floor board constructed in accordance with the present invention.

Referring now to FIGS. 1 to 3 of the drawings, there is shown generally at 10 a composite engineered wood material piece, herein a floor board constructed in accordance with the present invention. As herein illustrated, the engineered floor board 10 is comprised of a quality wood, thin, top layer 11 bonded to the top surface 12' of a middle layer 12 formed from a high density fiber board (HDF) material. The binder material is a suitable glue 13 of a type well known in the industry. The middle layer 12 is bonded to the top surface 14' of a bottom layer 14 herein an oriented strand board (OSB) material. The OSB material is positioned such that the particle orientation in the top surface 14' thereof extends parallel to the grain orientation 15 such being indicated by arrow 16 in FIG. 1.

Figure 4:
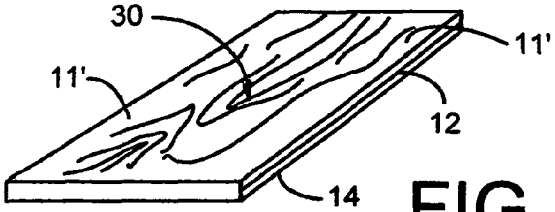
FIG. 4 is a schematic perspective view of a large composite material sheet constructed in accordance with the present invention.

The high density fiber board middle layer 12 forms the transition between the high quality thin top wood layer 11 and the inferior quality bottom layer 14 formed of a oriented strand board. It also strengthens the composition of the floor board 10 or a sheet 30 formed from this composition, as illustrated in FIG. 4. The middle layer also acts as a barrier to prevent the telegraphy of imperfections in the top rough surface 14' of the bottom layer from reflecting or telegraphing into the top surface of the top layer.

As can be seen more clearly in FIGS. 2 and 3, the bottom layer 14 is much thicker that the middle layer 12 and the top layer 11. Accordingly, the thickness of the board 10 can be increased at low cost as the OSB material is inexpensive as compared to the quality material top layer. The OSB material is well known in the art, and is a variable density particle wood board having irregular rough surfaces caused by the fabrication thereof which is comprised of a mixture of wood strands 25 and wood flakes 26 which lie unevenly across each other and held by glue added to the mixture. Also, these fibers and flakes come from various different wood types. The OSB bottom layer may be formed from alternating longitudinal and transverse layers or coatings of wood strands and flakes in the ratio of 40% to 60% or 50% to 50%. The OSB bottom layer of the present combination preferably has a thickness swell of between 10% to 14% whereby to resist to stress in the top layer transferred to it through the middle layer. It also has an internal bond (IB) of at least 0.4 MPa (60 psi).

The middle HDF layer 12 is a high density compressed fiber board which does not split or crack and therefore is an ideal transition layer between the rough top surface 14' of the OSB and the high quality hardwood top layer 11. The OSB layer 12 has herein in the combination of layers, has an internal bond (IB) of at least 1.4 MPa (200 psi) whereby to resist to stress exhibited by the top layer 11 when subjected to changes in climatic conditions causing it to expand and retract. It also has a thickness swell of not more than 0.8 mm.

The top layer is formed from hardwood materials such as, maple wood, oak wood, walnut and other quality wood products cut into thin slices. In the composition of the present invention, the top wood layer has a thickness in the range of between 0.5 to 3 mm.

The composite engineered floor board 10 of the present invention has the following characteristics. As mentioned above, the top layer 11 has a thickness in the range of from about 0.5 to 3 mm. The middle layer has a thickness in the range of from about 2 to 5 mm, and the bottom layer has a thickness in the range of from about 6 to 20 mm. Therefore, the total thickness of the composite engineered floor board 10 or the wood material sheet 30, of the present invention is in the range of from about 8.5 mm to 25.5 mm. Preferably, the total thickness is from about 8.5 mm to 19 mm.

As shown in FIG. 1, the composite engineered floor board 10 is an elongated floor board defining longitudinal side edges 20 and end edges 21. It also has grooves or slits 17 formed in a spaced-apart manner in the bottom surface 18 of the OSB layer 14 to provide longitudinal flexion to the floor board 10. As illustrated in FIG. 3 tongue and groove formations 22 and 23 respectively are formed in these side and end edges for interconnecting these floor boards 10 together in side-by-side and end-to-end relationship.

With reference again to FIG. 4, the sheet 30 (usually measuring four feet by eight or nine feet in dimension), and formed of the composition of the present invention, may have several applications. For example, the top layer 11' could have shallow grooves formed therein extending longitudinally and transversally to depict floor boards of specific dimensions disposed in a pattern. Several other uses of such a composite wood material sheet are also contemplated.

It is within the ambit of the present invention to cover any obvious modifications of the example of the preferred embodiment described herein, provided such modifications fall within the scope of the appended claims.

The invention claimed is:

1. A composite engineered floor board formed of three laminated wood material layers piece comprising a top layer formed of a hardwood product bonded to a top surface of a middle layer formed from a high density fiber board (HDF) material, and a bottom layer formed of oriented strand board (OSB) material bonded to a bottom surface of said high density fiber board, said oriented strand board having a particle orientation in a top surface thereof extending parallel to the grain orientation of said top layer, said middle layer being a transition layer between said top layer and said bottom layer to provide resistance to flexion and torsion when said floor board is subjected to changes in climatic conditions and loads and providing a bonding surface to an irregular surface of said bottom layer to incorporate said oriented strand board in said floor board without directly bonding said oriented strand board to said top layer, and wherein said bottom layer has a thickness greater than the thickness of said middle layer.

2. The composite engineered wood material piece as claimed in claim 1 wherein said wood material piece is a floor board.

3. The composite engineered wood material piece as claimed in claim 2 wherein said middle layer has an internal bond strength (IB) of at least 1.4 MPa (200 psi) to resist to said flexion and torsion.

4. The composite engineered wood material piece as claimed in claim 3 wherein said middle layer has a thickness swell of not more than 0.8 mm.

5. The composite engineered wood material piece as claimed in claim 2 wherein said bottom layer has an internal bond strength (IB) of at least 0.4 MPa (60 psi).

6. The composite engineered floor board as claimed in claim 5 wherein said bottom layer also has a thickness swell of between 10% to 14% to resist to said stress transferred thereto through said middle layer.

7. The composite engineered floor board as claimed in claim 5 wherein said bottom layer has alternating longitudinal and transverse coatings of wood strands mixed with wood flakes in the ratio of 40% to 60%, or 50% to 50%.

8. The composite engineered floor board as claimed in claim 2 wherein said top layer has a thickness in the range of from about 0.5 to 3 mm, said middle layer having a thickness in the range of from about 2 to 5 mm, and said bottom layer having a thickness in the range of from about 6 to 20 mm.

9. The composite engineered floor board as claimed in claim 8 wherein the total thickness of said composite engineered floor board is in the range of from about 8.5 mm to 25.5 mm.

10. The composite engineered floor board as claimed in claim 8 wherein the total thickness of said composite engineered floor board is preferably in the range of from about 8.5 mm to 19 mm.

11. The composite engineered floor board as claimed in claim 2 wherein said bottom layer is a variable density particle wood board material having irregular surfaces caused by its fabrication from wood strands and flakes lying unevenly across each other, said middle layer being comprised of wood fiber board which will not split or crack and therefore acting as said transition layer between said top layer and a top rough surface of said bottom layer, said middle layer also acting as a barrier to prevent the telegraphy of imperfections in said top rough surface of said bottom layer into an outer surface of said top layer.

12. The composite engineered floor board as claimed in claim 2 wherein said composite engineered floor board is an elongated rectangular floor board defining longitudinal side edges and transverse end edges, and wherein inter-engaging formations are integrally formed in said side and end edges for interconnecting a plurality of said floor boards together.

13. A composite wood material sheet formed of three laminated sheets comprising a top sheet layer formed of a hardwood product bonded to a top surface of a middle sheet layer formed from a high density fiber HDF board material, and a bottom sheet layer formed of oriented strand board (OSB) material bonded to a bottom surface of said high density fiber board, said middle sheet being a transition sheet between said top sheet layer and said bottom sheet layer providing resistance to flexion and torsion when said composite wood material sheet is subjected to changes in climatic conditions and loads and providing a bonding surface to an irregular surface of said bottom sheet to incorporated said bottom sheet in said composite wood material sheet without directly bonding said bottom sheet to said top sheet, and wherein said bottom sheet layer has a thickness greater than the thickness of said middle sheet.

14. The composite wood material sheet as claimed in claim 13 wherein said oriented strand board (OSB) has its particle orientation in a top surface thereof extending parallel to the grain orientation in said top layer.

15. The composite wood material sheet as claimed in claim 14 wherein said top sheet layer has a thickness in the range of from about 0.5 to 3 mm, said middle sheet layer having a thickness in the range of from about 2 to 5 mm, said bottom sheet layer having a thickness in the range of from about 6 to 20 mm.

16. The composite wood material sheet as claimed in claim 15 wherein the total thickness of said composite engineered wood material sheet is in the range of from about 8.5 mm to 19 mm.

17. The composite wood material sheet as claimed in claim 13 wherein said middle sheet layer has an internal bond strength (IB) of at least 1.4 MPa (200 psi) to resist to said stress exhibited by said top layer sheet and caused by expansion and retraction of said top layer sheet, said bottom sheet layer having an internal bond strength (IB) of at least 0.4 MPa (60 psi).

18. The composite wood material sheet as claimed in claim 13 wherein said middle sheet layer has a thickness swell of not more than 0.8 mm, and said bottom sheet layer having a thickness swell of between 10% to 14%.

19. The composite wood material sheet as claimed in claim 13 wherein said bottom sheet layer is an OSB sheet layer which is a variable density particle wood board material having irregular surfaces caused by its fabrication from wood strands and flakes lying unevenly across each other, said middle sheet layer being comprised of a wood fiber board which will not split or crack and therefore acting as said transition sheet layer between said top sheet layer and a top rough surface of said bottom sheet layer, said middle sheet layer also acting as a barrier to prevent the telegraphy of imperfections in said top rough surface of said bottom sheet layer into an outer surface of said top sheet layer.

* * * * *